United States Patent [19]

Lister

[11] 4,271,814

[45] Jun. 9, 1981

[54] HEAT EXTRACTING APPARATUS FOR FIREPLACES

[76] Inventor: Paul M. Lister, 1803 General Anderson Ave., Vancouver, Wash. 98661

[21] Appl. No.: 914,056

[22] Filed: Jun. 9, 1978

Related U.S. Application Data

[63] Continuation-in-part of Ser. No. 792,410, Apr. 29, 1977, abandoned.

[51] Int. Cl.[3] ..... F24B 7/00

[52] U.S. Cl. ..... 126/121; 126/131

[58] Field of Search ..... 126/121, 131, 130, 298, 126/63, 164; 237/51; 138/39

[56] References Cited

U.S. PATENT DOCUMENTS

| | | | |
|---|---|---|---|
| 1,326,812 | 12/1919 | Waggoner | 126/130 |
| 2,813,708 | 11/1957 | Frey | 138/39 |
| 2,828,078 | 3/1958 | Snodgrass | 237/51 |
| 3,452,737 | 7/1969 | Pellegrino et al. | 126/121 |
| 3,866,595 | 2/1975 | Jones | 126/121 |
| 3,880,141 | 4/1975 | Abshear | 126/121 |
| 4,008,706 | 2/1977 | Buanno | 126/121 |
| 4,092,976 | 6/1978 | Buckner | 126/63 |
| 4,103,669 | 8/1978 | Pauley | 126/121 |
| 4,114,590 | 9/1978 | Frahm | 126/121 |
| 4,170,218 | 10/1979 | Hartley | 126/121 |

*Primary Examiner*—Samuel Scott
*Assistant Examiner*—Lee E. Barrett
*Attorney, Agent, or Firm*—Eugene M. Eckelman

[57] ABSTRACT

An upstanding heating chamber is disposed adjacent a wall of a fireplace for exposure to the fire, and tubular inlet and outlet ducts lead from the heating chamber along the bottom wall of the fireplace to the front. A blower circulates air through the inlet duct into the heating chamber and out the outlet duct into the room. The apparatus is arranged for use with existing fireplaces or can be built into new fireplaces.

2 Claims, 12 Drawing Figures

HEAT EXTRACTING APPARATUS FOR FIREPLACES

REFERENCE TO PRIOR APPLICATIONS

This application is a continuation-in-part of application Ser. No. 792,410, filed Apr. 29, 1977, now abandoned.

BACKGROUND OF THE INVENTION

This invention relates to new and useful improvements in heat extracting apparatuses for fireplaces.

It is a well known fact that a considerable amount of heat from a fireplace escapes up the chimney and a fireplace is thus an inefficient manner of heating. Such comprises one disadvantage of fireplaces. Also, in the use of fireplaces, it is customary to use screens in the front of the fireplaces to prevent hot sparks from being thrown out into the room. In some instances glass doors have been mounted at the front in order to confine the hot sparks. It is found that glass doors increase the efficiency of the fireplace. However, the trapped heat within the fireplace opening raises the temperature to a point such that the structure of the fireplace can be damaged after a short while. Such comprises an additional disadvantage of fireplaces.

SUMMARY OF THE INVENTION

According to the present invention and forming a primary objective thereof, a heat extracting apparatus is provided for fireplaces which allows glass doors to be used thereon and at the same time extracts heat from the fireplace. Such lowers the temperature to a non-damaging level for the material forming the fireplace and at the same time the extracted heat is discharged into the room for increasing the efficiency of the fireplace.

The structure for carrying out the important objectives of the invention comprises a heating chamber arranged to be disposed in upright relation adjacent a wall of the fireplace for exposure to the fire, and this heating chamber is associated with tubular inlet and outlet ducts which lie along the bottom of the fireplace and support fuel for burning in the fireplace. Forced air means circulate air through the inlet and outlet ducts and through the heating chamber for discharge into the room. Air directing means in the apparatus are provided to insure efficient, friction free movement of air.

The invention will be better understood and additional objects and advantages will become apparent from the following description taken in connection with the accompanying drawings.

DETAILED DESCRIPTION OF PREFERRED EMBODIMENTS

Figure 1:
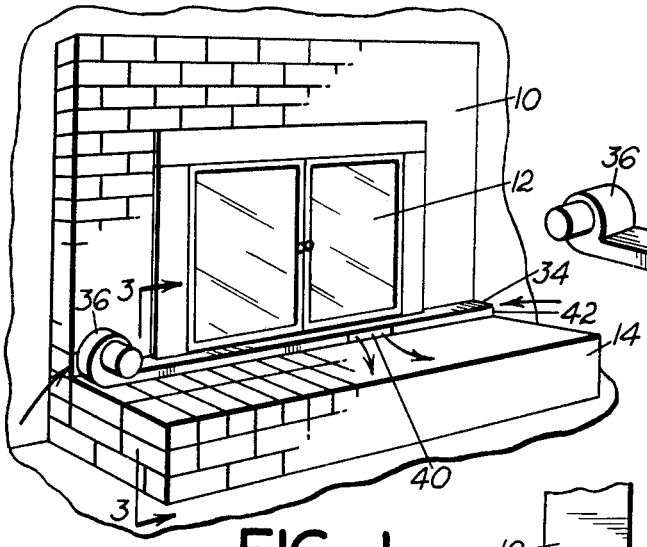
FIG. 1 is a perspective view of a first form of the invention applied to an existing fireplace.
Figure 2:
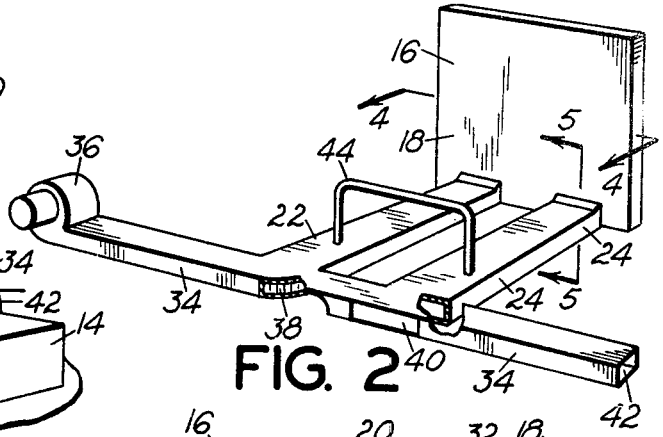
FIG. 2 is a perspective detail view of heat extracting apparatus of the invention as associated with the fireplace of FIG. 1.
Figure 3:
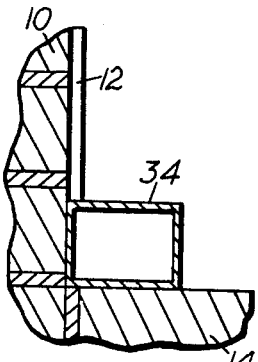
FIG. 3 is an enlarged fragmentary sectional view taken on the line 3—3 of FIG. 1.

With particular reference to the drawings, and first to FIG. 1, the numeral 10 designates a conventional fireplace having glass doors 12. As will be more apparent hereinafter, the doors 12 may comprise existing doors or may be installed with the apparatus of the invention. The numeral 14 designates a raised hearth which may comprise a part of the fireplace in existence or can be installed with the present apparatus, also as will be more apparent hereinafter.

With reference first to FIGS. 1 through 5, wherein the apparatus is adapted to a fireplace having a raised hearth, a heating chamber or box 16 is provided which preferably is located at the back of the fireplace in upright relation. This chamber is constructed of plate steel or other suitable material that will withstand the heat and is heat conductive and has front and rear walls 18 and enclosing top, bottom, and side walls 20.

Figure 5:
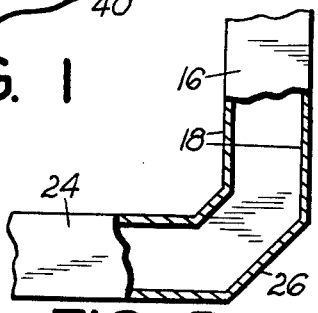
FIG. 5 is an enlarged, fragmentary elevational view partly broken away, taken on the line 5—5 of FIG. 2.
Figure 4:
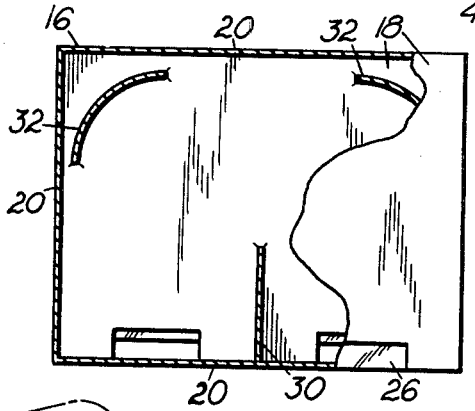
FIG. 4 is an enlarged elevational view, partly broken away, of a heating chamber used with the invention, this view being taken on the line 4—4 of FIG. 2.

Leading forwardly from the front wall of the heating chamber 16 at the bottom thereof are two flat ducts or conduits 22 and 24. Each of these ducts communicates with the interior of heating chamber 16, the duct 22 comprising an inlet duct for cold air and the duct 24 comprising an outlet for heated air. As best seen in FIG. 5, the inner terminal ends of the ducts have an upturned or angled portion 26 which provides smooth turn of air around the corner at the juncture of these ducts with the heating chamber. An upright baffle 30 is disposed between the front and rear walls of the heating chamber and between ducts 22 and 24 and extends upwardly from the bottom of the heat chamber through a portion of the height of the heating chamber to separate the inlet and outlet air. Heating chamber 16 also has corner baffles 32 which extend between the front and back walls 18 and which have a curved configuration to direct air in a smooth path at the corner areas. The principal flow of air moves freely past the concave surface of the baffles, and air on the other side of the baffles, namely, in the corners, is kept moving through the corners by the venturi effect of air moving past the baffles.

The outer ends of the ducts 22 and 24 are connected to a cross manifold 34 which seats on the hearth 14 and extends across the fireplace opening below the glass doors 12. Glass doors 12 may seat on the manifold if desired. One end of the manifold 34 has a blower 36 connected thereto having a suitable inlet for room air, and a curved partition 38 seals off the manifold and directs air into the inlet duct 22. The outer end of the outlet duct 22 communicates with the interior of the manifold 34, and an outlet opening 40 in the manifold discharges warm air from the duct 24 into the room.

The end 42 of the manifold opposite from the blower end is open whereby the flow of air from duct 24 across the manifold and out the opening 40 draws in room air through such open end. This arrangement provides for increased circulation in the room in which the fireplace is situated and also in other rooms of the house.

Figure 8:
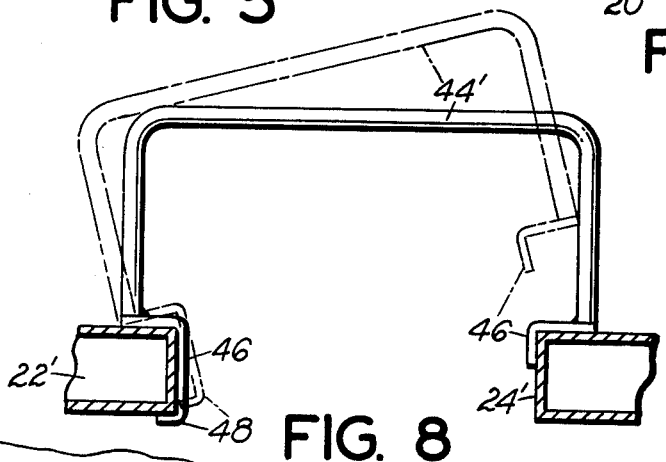
FIG. 8 is a sectional view taken on the line 8—8 of FIG. 7.
Figure 6:
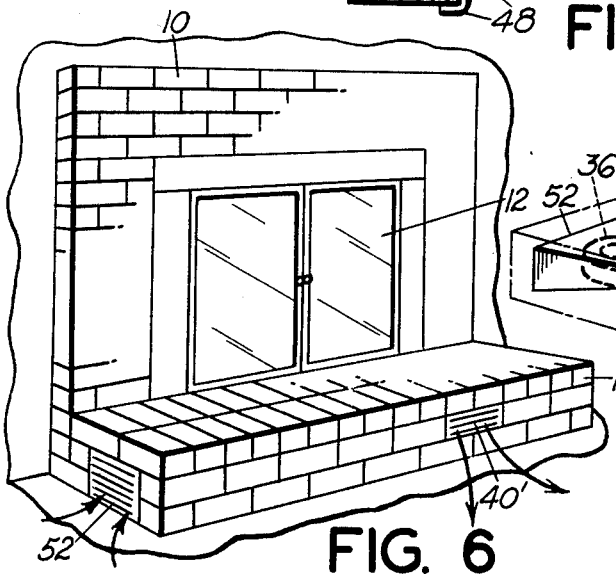
FIG. 6 is a perspective view showing a fireplace with the present invention constructed as a part thereof.
Figure 7:
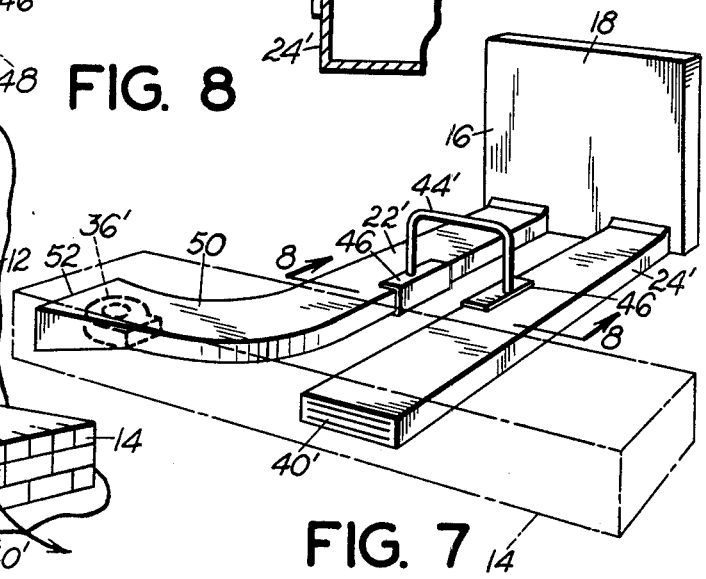
FIG. 7 is a perspective detail view of the heat extracting apparatus used with the embodiment of FIG. 6.

With reference to FIGS. 6, 7, and 8 the present invention is shown in an arrangement wherein the blower and some of the duct work is built into the hearth 14. In this embodiment the heating chamber 16 is the same as described in connection with FIG. 1, and this heating chamber has similar association with an inlet duct 22' and an outlet duct 24'. Blower 36' is installed in a passageway 50 constructed in the hearth, and this passageway leads into and communicates with the outer end of inlet duct 22'. The outlet duct 24' extends through the hearth and has an opening 40' into the room. An inlet 52 is provided at one end of the hearth for entrance of inlet air to the blower.

In the installation of the present apparatus, the heating chamber 16 is installed upright adjacent one wall of the fireplace, preferably the back wall. The ducts 22 and 24, or 22' and 24', extend forwardly along the floor of the fireplace and support the fireplace fuel. By the arrangement of the heating chamber 16 and the ducts, a large heat transfer area is provided to extract maximum heat from the fireplace. The present apparatus in removing a considerable amount of the heat from the fireplace into the room, greatly improves the efficiency of the fireplace. In addition, the removed heat maintains the fireplace at a lowered temperature so that damage is not done to the defining walls. The circulation provided by the inlet and outlet, and also by the end opening 42 in the FIG. 1 embodiment, provides for effective circulation in the room in which the fireplace is disposed as well as in other rooms of the house thus decreasing the amount of fuel required in a central heating system if any. The flat rectangular ducts 22 and 24, or 22' and 24', are not subject to overheating since a large surface thereof is in cooling contact with the fireplace floor.

FIGS. 7 and 8 show a modified form of andiron wherein an inverted U-shaped bar 44' is adjustably supported on the inlet and outlet ducts 22' and 24', respectively, by angle irons 46 which fit over inner opposed edges of the ducts. One of the supports 46 has a projection 48 which extends under one of the ducts when the andiron is in place, and such projection prevents the andiron from tipping outwardly. This projection also anchors the andiron in place when engaged by fuel in the fireplace since such fuel will tend to tip the andiron outwardly which causes engagement of the projection upwardly against its associated duct to provide a friction hold. The andiron can be readily removed by tipping it up at one side as shown in broken lines in FIG. 8.

Figure 9:
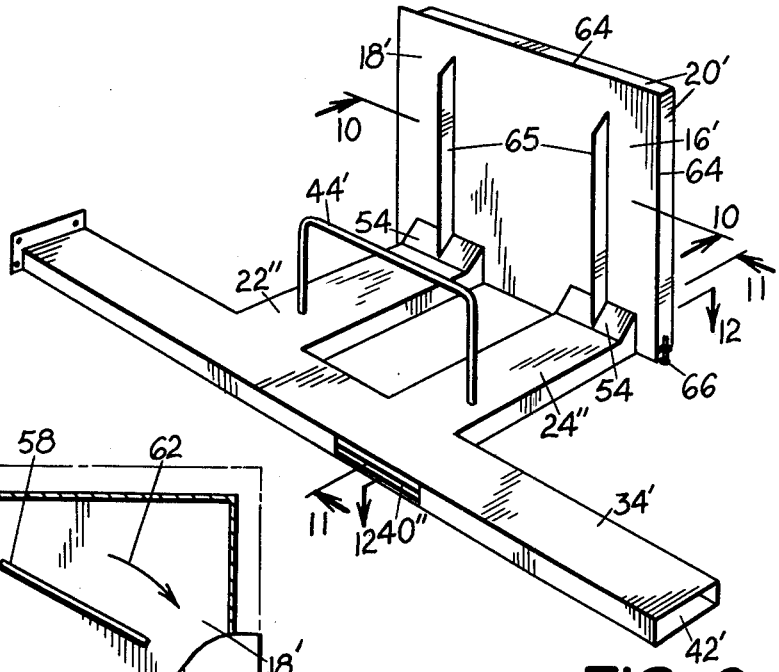
FIG. 9 is a perspective view of a second form of the invention.
Figure 10:
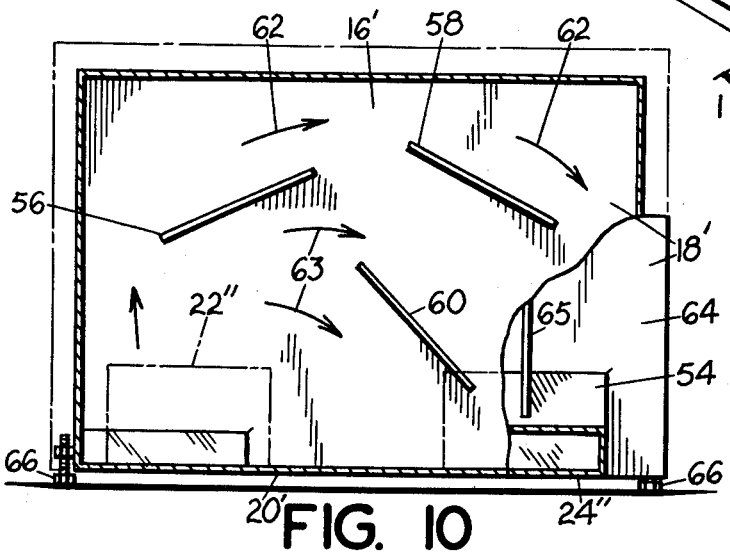
FIG. 10 is an enlarged front elevational view, partly broken away, of a heating chamber used with the embodiment of FIG. 9, this view being taken on the line 10—10 of FIG. 9.
Figure 11:
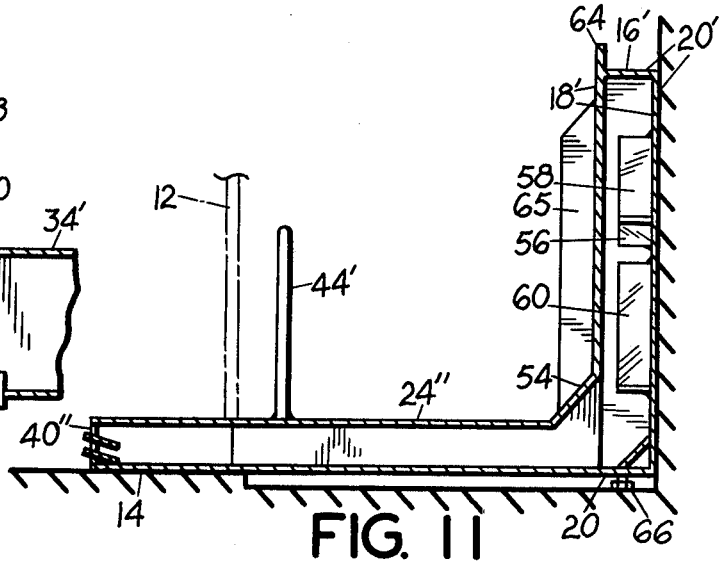
FIG. 11 is an enlarged sectional view taken on the line 11—11 of FIG. 9.

FIGS. 9–11 show a somewhat modified form of the invention. Similar to the other forms of the invention, this embodiment employs a heating chamber 16' having front and rear walls 18' and peripheral walls 20'. Flat inlet and outlet ducts 22" and 24", respectively, are similarly employed. The inner terminal ends of the ducts are connected into a heating chamber or box 16' and their front ends lead in from a cross manifold 34'. Manifold 34' is open at one end 42' and has means at its other end for attachment to a blower, not shown, wherein cold air is moved into duct 22" by a curved partition 38' and from there it travels through heating chamber 16', through outlet duct 24", and then through an outlet opening 40" in the front of the manifold 34'.

Ducts 22" and 24" are connected into the respective bottom corners of the chamber 16' and have an upwardly angled portion 54 leading into the chamber to provide a smooth flow of air in this angled path. Three baffles 56, 58 and 60 are provided in the heating chamber 16' and have the selected shape and arrangement as shown in FIG. 10. As best seen in FIG. 11, these baffles are secured to the rear wall of the heating chamber 16' and terminate short of the front wall. This open area in front of the baffles causes a blending or agitation of the moving air for more uniform heating.

Baffle 56 is disposed above the opening of duct 22" but offset somewhat from such opening toward the center of the heating chamber. It is spaced from the adjacent side and from the top of the heating chamber in an angled or oblique relation, thus allowing forced air to flow around the left side and over the top thereof. Baffle 58 is disposed above the opening of duct 24" and offset somewhat from such opening toward the center of the heating chamber. It is spaced from the adjacent side and from the top of the heating chamber in an angled or oblique relation oppositely from that of baffle 56, thus forming a continuation of flow around the outer portion of the chamber. Baffle 60 is disposed in an angled or oblique relation somewhat similar to baffle 58 with its lower end just above the outlet 24" and in partially overlapping relation with said opening.

The particular arrangement of baffles has been found to provide an effective heat pickup for air moving through the heating chamber. This arrangement also prevents the heating chamber from developing hot spots therein. Most of the forced air will flow over the top of the baffles 56 and 58 in a wide path between the inlet and outlet ducts, this air flow being shown by arrows 62. Some of the flow, however, will impinge against the bottom of baffle 56 and be deflected to the right in paths above and below baffle 60 as shown by arrows 63 for movement to the outlet 24". Also, the fast movement of the air around the outside in the direction of arrows 62 causes a vacuum or siphoning effect on the left side of baffle 58 and some inlet air will be drawn in directly across from the inlet 22". Such distribution of air from the inlet 22" to the outlet 24" provides the even distribution mentioned to provide good heat pickup and to maintain the heating chamber 60' at substantial uniform temperature throughout its entire area.

The front wall of heating chamber 16' is extended beyond the side and top walls to form a flange 64 on these three sides. This flange distributes the heat evenly in the outer portion of the heating chamber and protects welded portions that exist in the outer portions of such heating chamber.

The front wall of heating chamber 16' has a pair of integral upright ribs 65. These ribs maintain a spacing between the firewood and the front face of chamber 16' to allow flames and heat to circulate adjacent the front of the chamber for good heat pickup.

The embodiment of FIG. 9 employs adjustable feet 66 at each side of the chamber 60' for adjusting to the fireplace floor.

Figure 12:
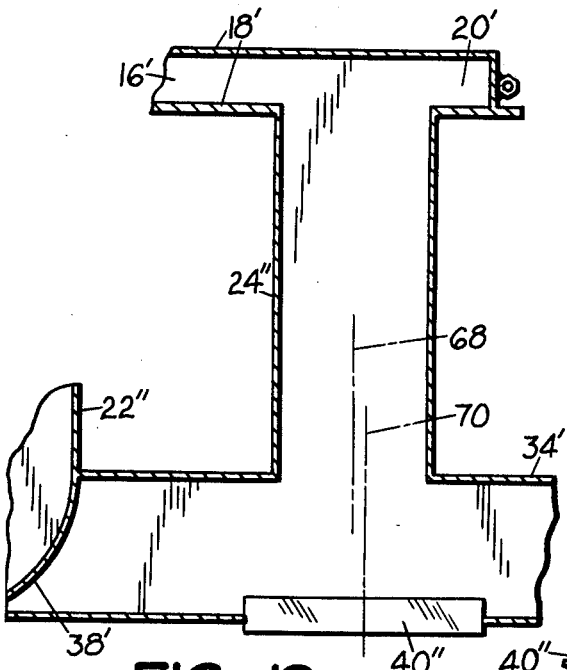
FIG. 12 is an enlarged fragmentary sectional view taken on the line 12—12 of FIG. 9.

With particular reference to FIG. 12, outlet opening 40" is wider than the outlet duct 24" and in addition is offset a slight amount toward the open end 42' of the manifold 34'. This offset is illustrated by broken lines 68 and 70 which represent respectively the center of duct 24' and the center of outlet opening 40". Because of the enlarged area of outlet opening 40'' relative to the cross sectional area of duct 24' and also because of the offset relationship of outlet opening 40'' relative to the open 42', a Venturi effect is accomplished and cold air is drawn in from the end 42' and is blended with hot air being discharged through the duct 24''. This blending sufficiently cools the heated outlet air to a safe and comfortable temperature.

Outlet 42' also serves another function as follows. Since the inlet to the blower at the opposite end of the manifold 34' is higher than the other opening 42' of the manifold, a draft flows out through the blower when such blower is shut off. With a fire in the fireplace, it is possible that overheating may thus damage the blower when it is not operating. With the use of the open end 42', however, this chimney effect is eliminated and instead cool air is drawn in through the blower. This flow of air results from a siphoning action created by the heat in duct 24'' pulling in cold air through opening 42'. The air thus drawn in discharges through outlet opening 40'' and this in turn causes a circulation through the ducts and the heating chamber which as stated causes air to flow in through the blower. Such flow of cool air through the blower maintains it at a safe and non-damaging temperature.

It is to be understood that the forms of my invention herein shown and described are to be taken as preferred examples of the same and that various changes in the shape, size and arrangement of parts may be resorted to without departing from the spirit of my invention, or the scope of the subjoined claims. For example, the apparatus can be used with fireplaces that do not have a raised hearth since the manifold 34 can lie at floor level. In addition ducts for admitting cold air to the blower 36, 36' can lead in from other rooms or from a central place in a residence. Furthermore, outlet 40, 40' can lead to other rooms or to a central place in the residence.

Having thus described my invention, I claim:

1. A heat extracting apparatus for fireplaces of the type having front doors, comprising (a) an upstanding heating chamber having front and rear walls and enclosing top, bottom and side walls and arranged to be disposed adjacent a wall of a fireplace for exposure to the fire, (b) inlet and outlet duct means connected into said heating chamber adjacent the bottom and adjacent respective opposite sides, (c) said inlet and outlet duct means being arranged to extend substantially horizontally along the floor of a fireplace and support firewood thereon, (d) a front cross duct connected to and communicating with said outlet duct means, (e) an outlet opening in said cross duct on the opposite side of the connection of said duct with said outlet duct means, (f) said opening being substantially aligned with said outlet duct means and in substantially the same horizontal plane, (g) an extension on said cross duct extending laterally beyond its connection with said outlet duct means, (h) said extension communicating with said outlet duct means and having an open end, (i) said outlet opening being larger in cross sectional area than the cross sectional area of said outlet duct means and also being offset laterally towards said open end relative to said outlet duct means whereby the forced outlet of heated air through said outlet opening provides a Venturi action which draws in room air through said open end to increase air circulation in a room.

2. A heat extracting apparatus for fireplaces of the type having front doors, comprising (a) an upstanding heating chamber having front and rear walls and enclosing top, bottom and side walls and arranged to be disposed adjacent a wall of a fireplace for exposure to the fire, (b) inlet and outlet duct means connected into said heating chamber adjacent the bottom and adjacent respective opposite sides, (c) said inlet and outlet duct means being arranged to extend substantially horizontally along the floor of a fireplace and support firewood thereon, (d) a first baffle in said heating chamber located upwardly from the connection of said inlet duct means into said heating chamber but downwardly from the top and inwardly from the adjacent side to allow a main flow of air to pass over the top of said baffle, (e) a second baffle in said heating chamber located upwardly from the connection of said outlet duct means into said heating chamber but downwardly from the top and inwardly from the adjacent side to allow said main flow of air which is passed over the first baffle to pass over said second baffle, (f) said first baffle extending obliquely relative to the vertical so that some of said air impinges against the bottom of said baffle and is directed laterally across said heating chamber, (g) said second baffle extending obliquely relative to the vertical to cause laterally moving air to be deflected downwardly toward said outlet duct means, (h) a third baffle in said heating chamber above the bottom thereof but below and laterally between said first and second baffles to allow the flow of air which is passed by said first and second baffles to pass over said third baffle, (i) said third baffle being disposed obliquely relative to the vertical to cause laterally moving air to be deflected downwardly, (j) a lower portion of said third baffle obliquely intersecting an upper and inwardly disposed portion of said outlet duct means, (k) and forced air means forcing air into said inlet duct, into said heating chamber, and then out said outlet duct into a room, (l) said main flow of forced air in passing over said first and second baffles being heated and also drawing air laterally across said heating chamber in a lower portion thereof and the flow of forced air in passing over said third baffle providing a Venturi action under said third baffle to draw air across a lower portion of said heating chamber.

* * * * *